United States Patent [19]

Yoshida et al.

[11] 4,358,319

[45] Nov. 9, 1982

[54] METHOD FOR MANUFACTURING COMMUTATOR

[75] Inventors: Makoto Yoshida, Machida; Satoru Baba, Yamato, both of Japan

[73] Assignee: Aupac Kabushiki Kaisha, Tokyo, Japan

[21] Appl. No.: 161,672

[22] Filed: Jun. 23, 1980

[30] Foreign Application Priority Data

Jul. 2, 1979 [JP] Japan ..... 54-83609
Feb. 21, 1980 [JP] Japan ..... 55-19720

[51] Int. Cl.[3] ..... B22F 5/00

[52] U.S. Cl. ..... 75/200; 29/597; 75/201; 75/214; 75/224; 75/225; 75/226; 310/233; 310/236

[58] Field of Search ..... 75/208 R, 226, 225, 75/224, 201, 214, 200; 310/233, 236; 29/597

[56] References Cited

U.S. PATENT DOCUMENTS

| | | | |
|---|---|---|---|
| 2,053,662 | 9/1936 | Hardy | 75/200 X |
| 3,248,215 | 4/1966 | Bonis et al. | 75/226 |
| 3,568,309 | 3/1971 | Preece | 29/597 |
| 3,812,576 | 5/1974 | Yamaguchi | 29/597 |
| 3,837,819 | 9/1974 | Hibbs | 310/233 X |
| 4,188,713 | 2/1980 | Kawano et al. | 310/236 X |

FOREIGN PATENT DOCUMENTS

| | | | |
|---|---|---|---|
| 63662 | 7/1892 | Fed. Rep. of Germany . | |
| 1034262 | 7/1958 | Fed. Rep. of Germany | 310/233 |
| 54-132413 | 10/1979 | Japan . | |

OTHER PUBLICATIONS

Chem Abstracts * 92 p. 309, item 151694e, May 5 '80, "Wear Resistant Sintered Alloy Composites for Sliding Use".

*Primary Examiner*—Helen M. McCarthy
*Attorney, Agent, or Firm*—Polster, Polster and Lucchesi

[57] ABSTRACT

A method for manufacturing commutator for use in rotary electric machines, in which a shaping material prepared from electrically conductive metal powder material or a mixture of the metal powder material and additive powder material such as carbon, molybdenum disulfide, etc. is placed in a shaping mold and subjected to compression-molding into annular or cylindrical shaped electrically conductive body, then an electrically insulative synthetic resin material is coated around, or filled in, the hollow cavity of the annular or hollow cylindrical body, and thereafter this annular or cylindrical body is machined to be divided into a plurality of segments for constituting the commutator.

8 Claims, 38 Drawing Figures

METHOD FOR MANUFACTURING COMMUTATOR

BACKGROUND OF THE INVENTION a. Field of the Invention

This invention relates to a commutator. More particularly, it is concerned with a method for readily mass-producing a commutator having predetermined electrical characteristics (such as contact resistance, contact ripper, etc.), mechanical characteristics (such as low friction, low brush noise, etc.), and high mechanical strength as required of it so as to be adaptable to particular rotary machines.

b. Description of Prior Arts

Heretofore, this kind of commutator has been manufactured by punching sheet metal material, using a pressing machine, in a predetermined shape of the commutator having required numbers divided commutator segments, and the thus punch-shaped metal sheets are laminated in a plurality of numbers to a predetermined thickness.

According to such method of manufacture, however, since the sheet metal should be formed in a predetermined cross-sectional shape of the commutator segments by the punching press, then the metal sheet thus punch-shaped should further be laminated to a predetermined thickness to obtain a desired commutator, and other process steps should be taken up, maintenance in precision of the size is difficult, and, in particular, when the commutator for a small or miniature-sized motor is to be manufactured, it is all the more difficult to form such mini-size cross-sectional pattern of the commutator segments by the punching press, on account of which productivity of the commutator cannot but be low inevitably.

Moreover, the conventional method of manufacturing the commutator has been such that it is made of a metal material alone, and the brush to be contacted with the commutator is made of carbon. In practical use of these commutator and brush, since the metal material constituting the commutator and carbon constituting the brush have different material hardness from each other, and, moreover, since the circumference of the commutator to be in contact with the brush is longer than the length of contact of the brush with the commutator, the brush inevitably suffers from serious wear and tear for the difference in the material hardness and the contact length with the consequence that not only much time is taken for replacing the brush, but also brush replacement per se is uneconomical, if not impossible, hence the service life of the motor, etc. is naturally limited.

SUMMARY OF THE INVENTION

The present invention has been made with a view to overcoming such defects in the conventional method of manufacturing the commutator as mentioned above, and to providing a commutator having stable electrical and mechanical characteristics most suited for any desired rotary electric machine.

It is therefore the primary object of the present invention to provide a new and improved method for readily manufacturing the commutator of a uniform dimension in a simplified working step and in a scale of industrialized mass-production.

It is the secondary object of the present invention to provide a method of manufacturing a commutator for a rotary electric machine having a stable electrical as well as mechanical characteristics.

It is the third object of the present invention to provide a method for manufacturing a commutator for a rotary electric machine having high mechanical strength in an easy way.

It is the fourth object of the present invention to provide a method for manufacturing a commutator, in which a base body to constitute the commutator is shaped by compressing a forming material prepared from an electrically conductive metal powder material, or by mixing such metal powder material with carbon powder or like other additive material for enhancing desired electrical and mechanical characteristics, and filled in a shaping mold, and, if further necessary, the base body is subjected to sintering and re-compression.

Thus, according to the present invention, in one aspect thereof, there is provided a method for manufacturing commutator, comprising: (a) preparing a shaping material; (b) placing said shaping material in a shaping mold; (c) compression-molding said shaping material in said shaping mold to form an electrically conductive annular body; (d) subjecting said compression-molded annular body to sintering; (e) covering said electrically conductive annular body with an electrically insulative synthetic resin bearing material in a manner to expose its one surface side to outside to a substantial extent; and (f) forming a plurality of radial slits at substantially equal space intervals from the side of the exposed surface of said electrically conductive annular body to a depth reaching said electrically insulative synthetic resin bearing material, thereby dividing said electrically conductive annular body into a plurality of segments for the commutator.

According to the present invention, in another aspect thereof, there is provided a method for manufacturing commutator, comprising: (a) preparing a shaping material; (b) placing said shaping material in a shaping mold; (c) compression-molding said shaping material in said shaping mold to form an electrically conductive hollow cylindrical body; (d) subjecting said compression-molded body to sintering; (e) filling an electrically insulative synthetic resin material in the hollow cavity to integrally form a bearing member with said cylindrical body; and (f) forming a plurality of grooves in said electrically conductive cylindrical body from the outer peripheral surface thereof to a depth reaching said bearing member, and in parallel with the axial line, thereby dividing said cylindrical body into a plurality of sections, said divided sections being made commutator segments.

According to the present invention, in still another aspect thereof, there is provided a method for manufacturing commutator, which comprises: (a) preparing a shaping material; (b) placing said shaping material in a shaping mold; (c) compression-molding said shaping material in said shaping mold to form an electrically conductive cylindrical body with wall thickness at both end parts thereof being outwardly tapered; (d) subjecting said compression-molded body to sintering; (e) filling an electrically insulative synthetic resin material in the hollow cavity of said cylindrical body in a manner to cover said outwardly tapered peripheral surface to integrally form a bearing member; and forming a plurality of radial grooves in said cylindrical body to a depth reaching said electrically insulative synthetic resin bearing material at substantially equal space intervals from the outer peripheral surface thereof, thereby dividing said cylindrical body into a plurality of segments for the commutator.

There has thus been outlined, rather broadly, the more important features of the present invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based may readily be utilized as a basis for the designing of other structure for the carrying out of the several purposes of the present invention. It is therefore important that the claims be regarded as including such equivalent construction so far as they do not depart from the spirit and scope of the present invention.

BRIEF DESCRIPTION OF THE ACCOMPANYING DRAWING

Specific embodiments of the present invention have been chosen for the purpose of illustration and description, and are shown in the accompanying drawing, forming a part of the specification, in which.

Figure 21:
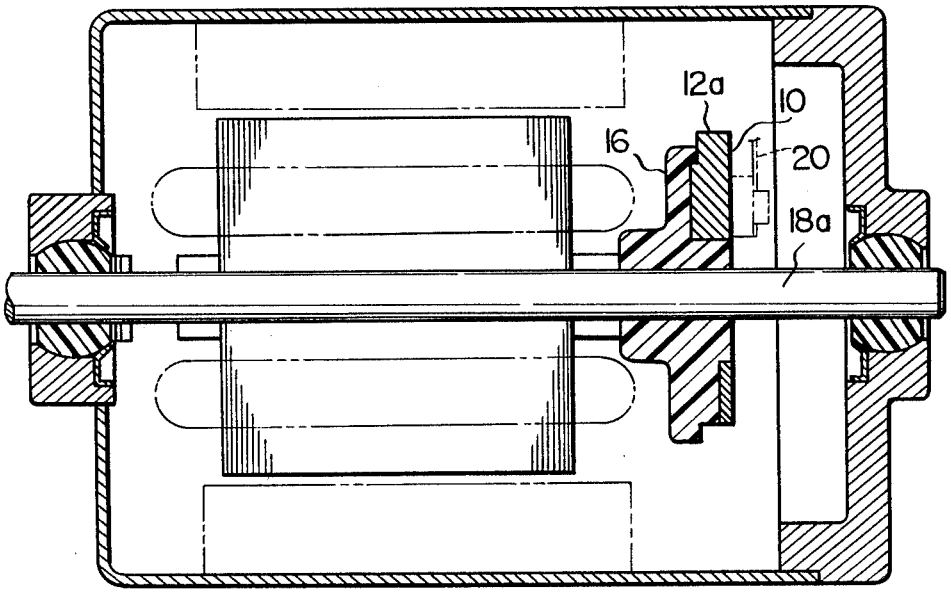
Figure 22:
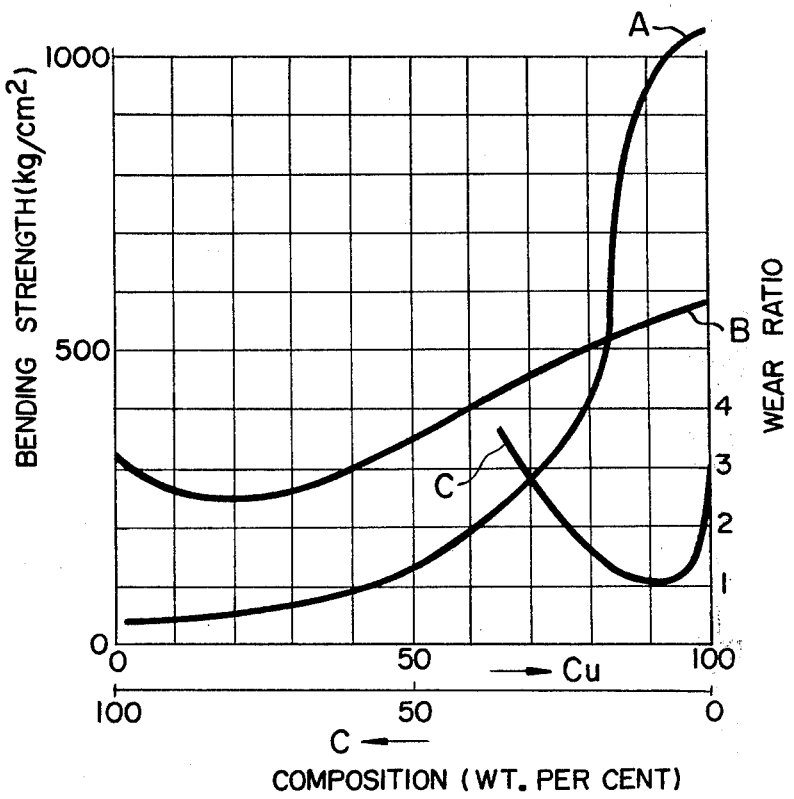

FIG. 21 is a side elevational view, partly in longitudinal cross-section, showing a state, in which the commutator in flat and annular configuration as shown in FIGS. 7A, 7B or 10A, 10B as manufactured in accordance with the present invention is actually mounted on a rotary electric machine; and FIG. 22 is a graphical representation showing bending strength and wear ratio of the commutator base body produced in accordance with the present invention.

DETAILED DESCRIPTION OF PREFERRED EMBODIMENTS

In the following, several preferred embodiments of the method of manufacturing the commutator according to the present invention will be explained in detail in reference to the accompanying drawing.

At first, electrically conductive metal powder material such as silver, copper, etc. is mixed with carbon powder (inclusive of carbon powder with a binder being contained therein), molybdenum disulfide, and so on for imparting to the metal powder material desired electrical and mechanical characteristics at a certain definite mixing ratio. This mixed powder material is filled in a shaping mold for shaping under pressure a base body of the commutator in a desired configuration such as hollow cylindrical form, flat annular form, and so forth.

In this case, by controlling the mixing quantity of the carbon powder to be mixed with the metal powder, and by selecting the kind of the metal material, there can be obtained desired electrical characteristics (contact resistance, contact ripple, etc.) as well as mechanical characteristics (low friction, low brush noise, etc.) for the commutator so that it may be most suited for an intended rotary electrical machine such as motor, dynamo, and others.

According to the experiments done by the present inventor, it has been found out that, when the shaping material is prepared by using copper as the metal powder material and carbon powder as the characteristic enhancing material, the bending strength and the wear ratio of the commutator base body as molded remarkably improves, in case the mixing ratio between copper and carbon is 80% and above for copper and 20% and below for carbon, as shown in FIG. 22. The bending strength and the wear ratio are found excellent when the mixing ratio is from 85% to 95% of copper and from 15% to 5% of carbon.

In FIG. 22, a curve A represents the bending strength of the shaped body after it is subjected to re-compression under 3 tons/cm$^2$; a curve B indicates the bending strength of the shaped body after it is subjected to compression molding under 3 tons/cm$^2$ followed by calcination; and a curve C shows the wear ratio of the above-mentioned shaped bodies—the wear ratio at the contact portion between the commutator and the brush.

The shaped body used for the experiments and the experimental conditions are as follows:

| | | |
|---|---|---|
| (1) | Shaped body | cylindrical commutator |
| (2) | Brush material | berylium copper leaf |
| (3) | Dimension of brush | 3 mm wide × 0.15 mm thick |
| (4) | Number of revolution | 10,000 rpm |
| (5) | Current | 500 mA |
| (6) | Voltage | 12 V |
| (7) | Number of slot in | |

-continued

| | |
|---|---|
| commutator | 3 |

Incidentally, by the term "wear ratio", it is meant a relationship between the mixing ratio of copper (weight %) and its wear, when the minimum value of wear at the contact portion between the commutator and the brush is made "1".

From the above, it will become understood that, in comparison with the case of forming the commutator base body with the metal material alone, the wear between the commutator and the brush becomes reduced when carbon is mixed in the metal material for the commutator base body. Accordingly, the corresponding brush can be formed of a metal material (including alloys), rather than carbon alone, so that one-sided wear in the brush, as has been experienced so far, can be avoided, and the life of the commutator becomes advantageously prolonged.

In one embodiment of the method for manufacturing the commutator according to the present invention, as shown in FIGS. 1A to 3B, the metal powder mixture of the abovementioned sort is placed in a shaping mold (not shown) and subjected to a compression-molding in the direction perpendicular to the face of the drawing sheet, thereby forming a hollow cylindrical base body 2 having a plurality of slits 1*a*, 1*b* and 1*c* radially extending outward from the hollow inside wall of the base body 2.

Figure 1A:
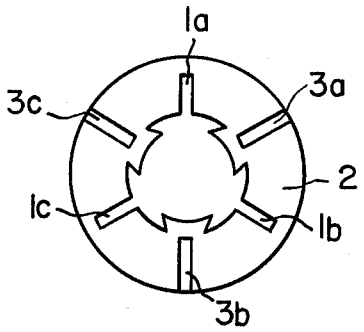
FIGS. 1A, 2A, 3A and 1B, 2B, 3B are respectively front views and side elevational views for explaining the process steps in one embodiment of the method for manufacturing the commutator according to the present invention.
Figure 1B:
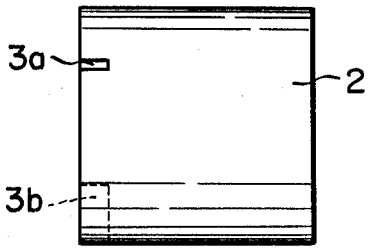
Figure 2A:
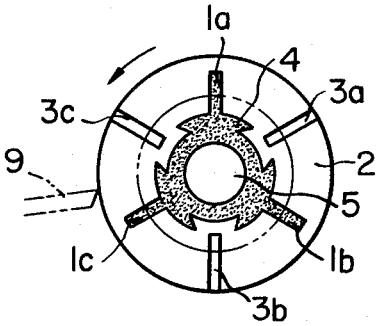
Figure 2B:
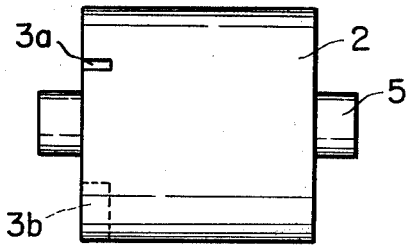

Subsequently, this hollow cylindrical base body 2 is sintered, then a center shaft 5 is passed through the hollow cylinder, and an electrically insulative synthetic resin 4 is filled in the hollow cylinder and the radially extending slits 1*a*, 1*b* and 1*c*, and solidified (FIG. 2A).

Thereafter, a cutting blade is caused to contact the outer peripheral surface of the cylindrical base body 2 to cut the cylindrical base body 2 from its outer surface until it reaches the slits 1*a*, 1*b* and 1*c* at a position shown in a double-dot-and-dash circle line in FIG. 2A either by rotating the hollow cylinder 2 itself or by moving the cutting blade 9 along the circumference of the cylinder 2. As the result of this cutting, the cylinderical base body 2 is divided into three segments 2*a*, 2*b* and 2*c* which are mutually insulated by the electrically insulative synthetic resin 4, whereby the commutator can be formed (FIGS. 3A and 3B).

Depending on circumstances, it may be feasible to make the surface level of the synthetic resin 4, which is usually flush with the surface of the commutator segments, lower than the surface of the segments 2*a*, 2*b* and 2*c* by removing or scraping the electrically insulative synthetic resin material 4 from the slits 1*a*, 1*b* and 1*c* to a required depth after the abovementioned cutting work. This is for avoiding any inconvenience which might be caused due to a difference in friction between the synthetic resin material 4 in the slits 1*a*, 1*b* and 1*c* and the segments 2*a*, 2*b* and 2*c*.

Since the commutator according to this embodiment is manufactured as mentioned in the foregoing, the segments 2*a*, 2*b* and 2*c* are naturally formed through the cutting work of the cylindrical base body 2, so that the machining work is simplified and the commutator having a uniform dimension can be readily manufactured in a scale of industrial mass-production. Moreover, since carbon can be mixed in the base body 2 forming the segments 2*a*, 2*b* and 2*c*, friction and thermal fusion between the commutator and the brush can be reduced to the minimum possible extent. As consequence of this, the brush noise becomes low, and the electrical contact between the commutator and the brush becomes stabilized. In addition, there are such other advantages that the contact ripple becomes small, electric spark due to instable contact between the commutator and the brush is reduced, and the life of the brush becomes prologned thereby. Also, as already mentioned in the foregoing, by mixing carbon in the commutator base body, there may be used, depending on the characteristic of an intended rotary electric machine, a brush which is formed of a metal material alone without inclusion of carbon therein.

Figure 3A:
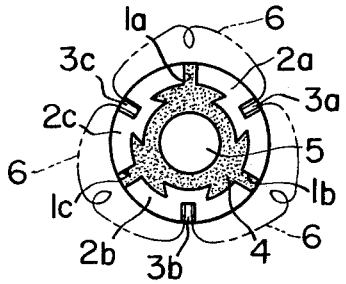
Figure 3B:
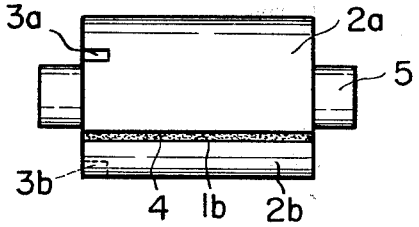
Figure 4A:
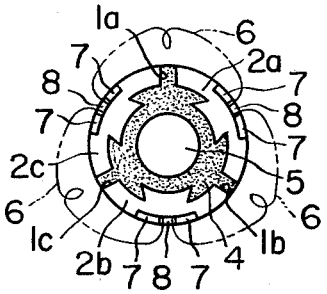
FIGS. 4A and 4B are respectively a front view and a side elevational view of the commutator manufactured in accordance with another embodiment of the manufacturing method according to the present invention.
Figure 4B:
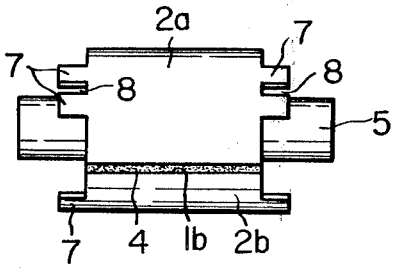

As shown in FIGS. 3A and 3B, the ends of windings 6 from the side of the rotary electric machine can befixed in cavities 3*a*, 3*b* and 3*c* formed inwardly of the end portion of each of the segments 2*a*, 2*b* and 2*c* by means of adhesive agent, solder, and so on. In other way, as shown in FIGS. 4A and 4B, small lugs 7, 7 for fixing the ends of the windings 6 are provided at the edge portion of each of the segments 2*a*, 2*b* and 2*c*, and each end of the winding is set between the fixing lugs 7, 7 followed by caulking of these lugs. Incidentally, as shown in FIG. 4B, when the fixing lugs 7, 7 are provided on both edges of the commutator segments 2*a*, 2*b* and 2*c*, the commutator can be conveniently assembled on the rotary electric machine in either left and right directions.

Figure 5A:
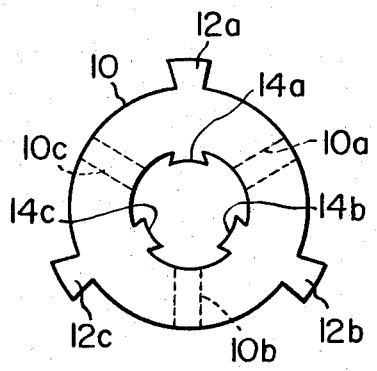
FIGS. 5A, 6A, 7A and 5B, 6B, 7B are respectively front views and side elevational views for explaining the process steps in still another embodiment of the method for manufacturing the commutator according to the present invention.
Figure 5B:
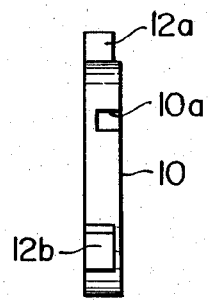

In the following, another embodiment of the method for manufacturing the commutator according to the present invention will be explained in reference to FIGS. 5A to 7B. Using the same shaping material of the metal powder mixture as in the abovementioned embodiment, a doughnut-shaped electrically conductive annular plate 10 is compression-molded in the direction perpendicular to the surface of the drawing sheet (FIGS. 5A and 5B). This doughnut-shaped electrically conductive annular plate 10 has a plurality of radial slits 10*a*, 10*b* and 10*c* formed in one surface side thereof, a plurality of connecting terminals 12*a*, 12*b* and 12*c* for lead wires projectively formed on the outer peripheral surface of the doughnut-shaped electrically conductive plate 10 at positions intermediate of the radial slits 10*a*, 10*b* and 10*c*, and embedding projections 14*a*, 14*b* and 14*c* provided on the inner peripheral surface of the doughnut-shaped electrically conductive annular plate at positions opposite to the abovementioned lead wire connecting terminals 12*a*, 12*b* and 12*c*.

Figure 6A:
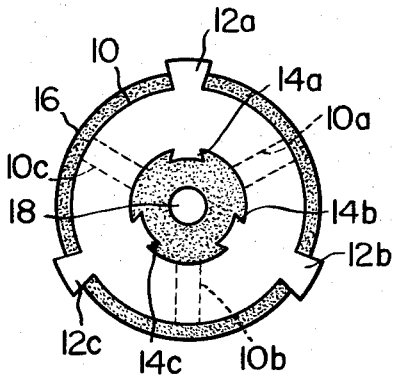

After the electrically conductive annular plate 10 has been sintered, it is subjected to re-compression in the same shaping mold, depending on necessity, to increase its mechanical strength and material hardness. After this, the doughnut-shaped electrically conductive annular plate is covered with an electrically insulative synthetic resin material, which surrounds its outer periphery as well as fills in the center hollow part and the radial slits in such a manner that at least one surface side of the doughnut-shaped electrically conductive annular plate 10 opposite the surface side where the radial slits are formed may be exposed outside to a substantial extent, thereby the synthetic resin bearing member 16 is formed (FIGS. 6A and 6B).

Figure 6B:
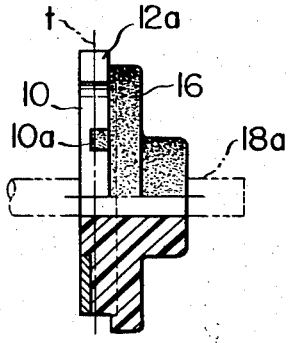
Figure 7A:
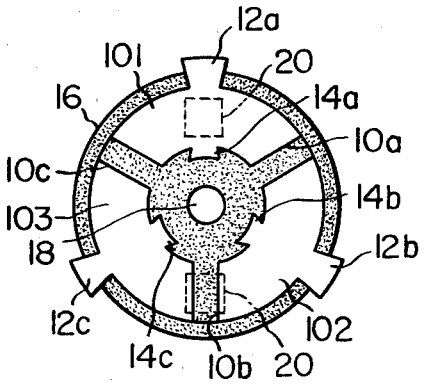
Figure 7B:
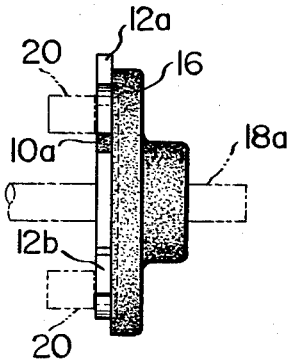

Next, the exposed surface of the doughnut-shaped electrically conductive annular plate 10 is sliced upto a position t in FIG. 6B reaching the slits 10*a*, 10*b* and 10*c* formed in the opposite surface side of the plate 10, whereby the same is divided into a plurality of commutator segments 101, 102 and 103 forming the intended commutator (FIGS. 7A and 7B). Incidentally, while the illustrated embodiment shows that the entire exposed surface of the doughnut-shaped electrically conductive annular plate 10 is sliced up to the position t, it may also be possible that only the portion opposite to the slits 10*a*, 10*b* and 10*c* be cut in the form of grooves.

Since, in the above-described embodiment shown in FIGS. 5A to 7B, the outer peripheral surface (except for the portion where the lead wire connecting terminals are provided), the inner peripheral surface, and the embedding projections 14*a*, 14*b* and 14*c* of the doughnut-shaped electrically conductive annular plate 10 are covered with the synthetic resin bearing member 16, and the slits 10*a*, 10*b* and 10*c* are filled by the synthetic resin material forming an integral part with the bearing member 16, there can be secured rigid cohesion between the commutator segments 101, 102 and 103 and the bearing member 16.

Figure 8A:
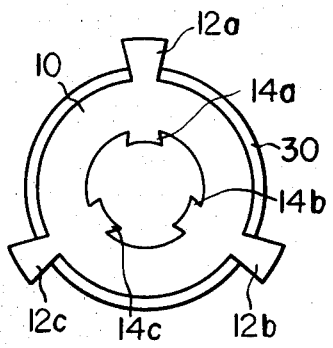
FIGS. 8A, 9A, 10A and 8B, 9B, 10B are respectively front views and side elevational views for explaining the process steps in yet another embodiment of the method for manufacturing the commutator according to the present invention.
Figure 8B:
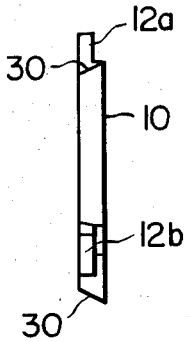
Figure 9A:
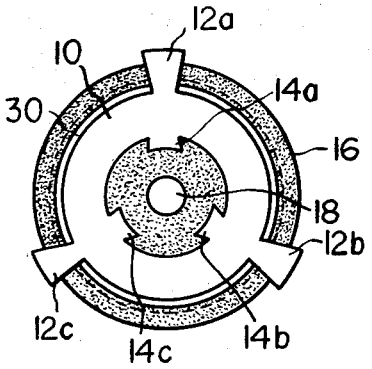
Figure 9B:
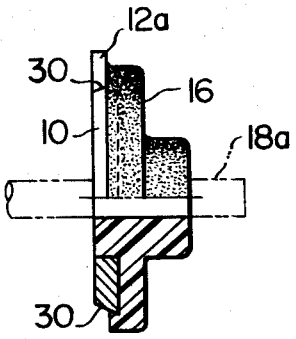

FIGS. 8A to 10B also illustrate still another embodiment of the method for manufacturing the commutator of the present invention, in which the doughnut-shaped electrically conductive annular plate 10 is obtained by compression-molding of the same shaping material as that used in the previous embodiment in FIGS. 5A to 7B. This doughnut-shaped electrically conductive plate 10 has a plurality of connecting terminals 12*a*, 12*b* and 12*c* for lead wires provided on its outer peripheral surface, the embedding projections 14*a*, 14*b* and 14*c* on its inner peripheral surface, and the outer peripheral surfaces between the lead wire connecting terminals 12*a*, 12*b* and 12*c* have been shaped to assume an inclined surface 30 (FIGS. 8A and 8B). This doughnut-shaped electrically conductive plate 10 is surrounded on its outer peripheral surface with the electrically insulative synthetic resin bearing member 16, and its hollow center part filled with the same material in the same manner as shown in FIGS. 6A and 6B (FIGS. 9A and 9B).

Figure 10A:
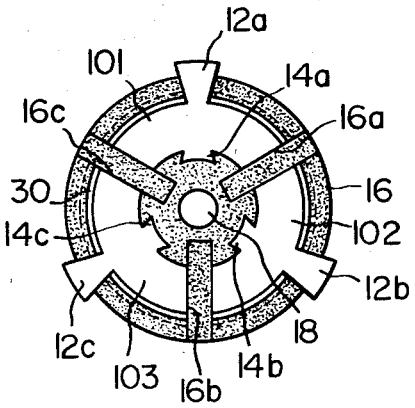
Figure 10B:
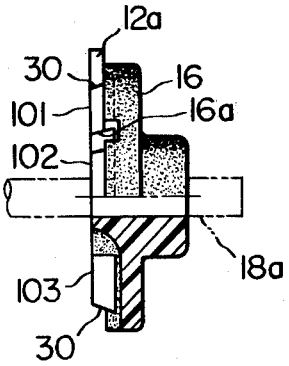
Figure 11A:
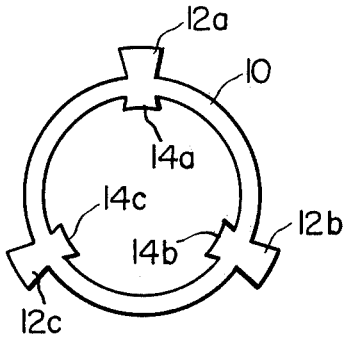
FIGS. 11A, 12A, 13A and 11B, 12B, 13B are front views and side elevational views for explaining the process steps in other embodiment of the method for manufacturing the commutator according to the present invention.
Figure 11B:
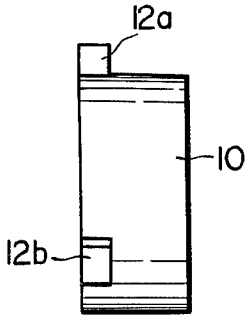

Subsequent to the above step, a plurality of radial slits 16*a*, 16*b* and 16*c* are formed on the exposed surface of the doughnut-shaped electrically conductive annular plate 10 to a thickness reaching the abovementioned synthetic resin bearing member 16 covering the opposite surface side, thereby dividing the doughnut-shaped electrically conductive annular plate 10 into a plurality of commutator segments 101, 102 and 103 to obtain a desired commutator (FIGS. 10A and 10B).

Since, in the above-described embodiment shown in FIGS. 8A to 10B, the inner and outer peripheral surfaces (particularly, the outer peripheral surface having the inclined surface 30) and the embedding projections 14*a*, 14*b* and 14*c* are well covered and filled with the synthetic resin bearing member 16, there can be secured strong cohesion among the commutator segments 101, 102 and 103. Also, since the slits 16*a*, 16*b* and 16*c* are formed between the adjacent commutator segments 101, 102 and 103, any inconvenience due to a difference in friction between the commutator segments and the synthetic resin bearing member can be avoided.

FIGS. 11A to 13B illustrate yet another embodiment of the method for manufacturing the commutator according to the present invention, in which an electrically conductive cylinder member 10 is formed by compression-molding of a material same as that shown in FIGS. 5A to 7B. This electrically conductive cylindrical body 10 has a plurality of lead wire connecting terminals 12*a*, 12*b* and 12*c* on the outer peripheral surface thereof, and embedding projections 14*a*, 14*b* and 14*c* on the inner peripheral surface thereof.

Figure 12A:
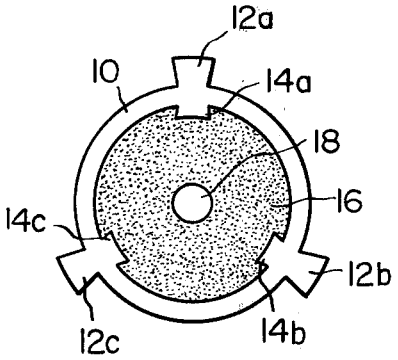
Figure 12B:
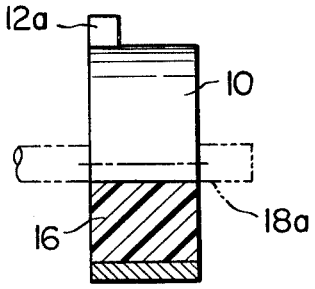

After this electrically conductive cylindrical body 10 has been sintered, it is integrally combined with an electrically insulative synthetic resin bearing member 16 in such a manner that at least one surface side thereof (outer peripheral surface) may be exposed (FIGS. 12A and 12B).

Figure 13A:
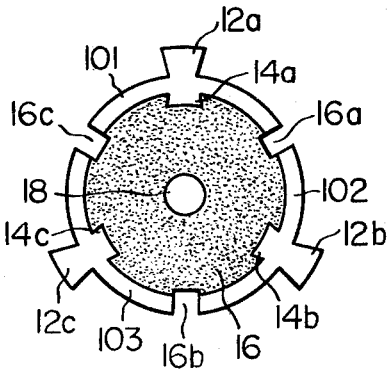
Figure 13B:
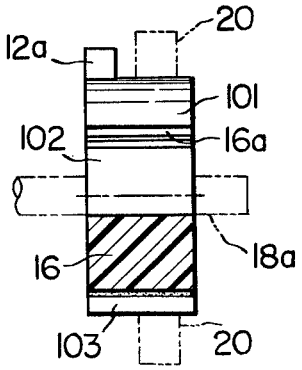

Subsequently, the electrically conductive cylindrical body 10 is cut in parallel with the axial line thereof from its exposed outer peripheral surface to a depth of reaching the synthetic resin bearing member 16 to form a plurality of slits 16*a*, 16*b* and 16*c* around it, thereby dividing the electrically conductive body 10 in a plurality of commutator segments 101, 102 and 103, thereby forming the commutator (FIGS. 13A and 13B).

Since, in the embodiment illustrated in FIGS. 11A to 13B, the embedding projections 14*a*, 14*b* and 14*c* are integrally combined with the synthetic resin bearing member 16, there can be secured strong cohesion between the commutator segments 101, 102 and 103 and the synthetic resin bearing member 16. Moreover, in the above-explained embodiments with reference to FIGS. 5A to 7B as well as FIGS. 8A to 10B, a brush 20 is caused to contact with the commutator segments at a plane orthogonally intersecting the axial line, as shown in the motor assembly of FIG. 21, while, in the embodiment shown in FIGS. 11A to 13B, the brush is caused to contact with the commutator segments at a plane parallel to the axial line thereof.

Since the commutator as described in the above embodiment is manufactured in such a manner, it is possible to produce, in an industrialized mass-production scale, the commutator having desired electrical and mechanical characteristics suitable for rotary electric machines like electric motors, generators, and so forth. Furthermore, by mixing carbon in the shaping material for the commutator base body, the brush to be contacted with the commutator may be made of a metal material alone.

Incidentally, the winding at the side of the rotary electric machine is attached to the lead wire connecting terminals 12*a*, 12*b* and 12*c* by electrically conductive adhesive agent, solder, and so forth. In FIGS. 5A through 13B, a reference numeral 18*a* designates a rotational shaft passed through the centeral hole 18 formed in the synthetic resin bearing member 16.

Figure 14A:
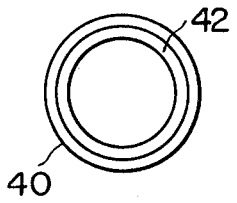
FIGS. 14A, 15A, 16A and 14B, 15B, 16B are respectively front views and side elevational views for explaining the process steps in still other embodiment of the method for manufacturing the commutator according to the present invention.
Figure 14B:
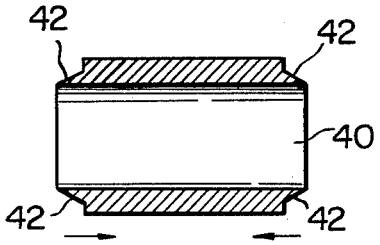

According to other embodiment of the present invention to be explained in reference to FIGS. 14A to 16B, the same shaping material prepared from the metal powder mixture as that used in the previous embodiments is filled in a shaping mold (not shown) and subjected to molding under pressure applied in the direction of an arrow in FIG. 14B, thereby obtaining an electrically conductive hollow cylindrical body 40 having a tapered surface 42 at both ends thereof where thickness of the tube wall reduces toward its edge.

Figure 15A:
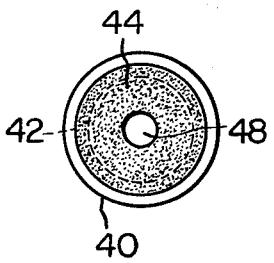
Figure 15B:
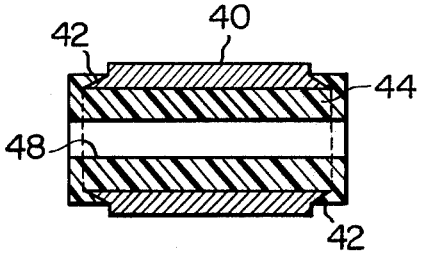

After the electrically conductive cylindrical body 40 has been sintered in a sintering furnace (not shown), it is further re-compressed in the shaping mold, depending on necessity, to increase its mechanical strength and material hardness. Thereafter, an electrically insulative synthetic resin is filled in the hollow cavity of the electrically conductive cylindrical body to cover the tapered surface 42 at both ends of the cylindrical body 40, followed by solidification of the same to form the bearing member 44 (FIGS. 15A and 15B).

Figure 16A:
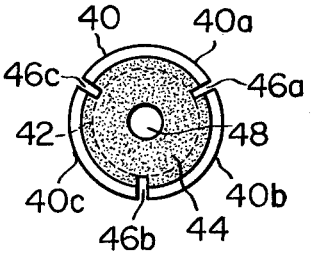
Figure 16B:
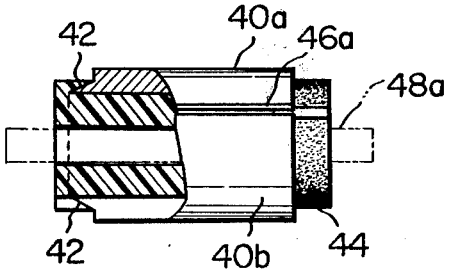

Subsequently, a plurality of slits 46*a*, 46*b* and 46*c* of a depth reaching the synthetic resin bearing member 44 are formed by a cutting machine (not shown) in the outer peripheral surface of the electrically conductive cylindrical body 40 in the direction parallel with the axial line thereof, thereby dividing the electrically conductive hollow cylindrical body 40 into a plurality of sections 40*a*, 40*b* and 40*c* at a substantially equal space interval between them. These divided sections are made the commutator segments to form the desired commutator (FIGS. 16A and 16B).

Figure 17:
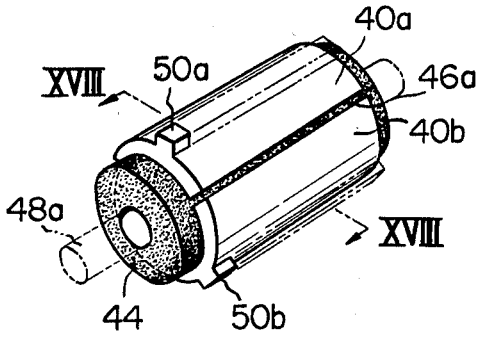
FIG. 17 is a perspective view showing an electrically conductive hollow cylindrical body suitable for manufacturing the commutator according to the present invention.
Figure 18:
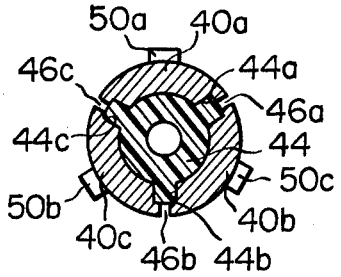
FIG. 18 is a cross-sectional view of an electrically conductive hollow cylindrical body similar to that shown in FIG. 17, with further modification being made thereto.

In the above-described embodiment, the end of each lead wire from the side of the rotary electric machine is directly attached to each of the commutator segments with solder or electrically conductive adhesive agent. However, connection of the lead wire to each commutator segment becomes facilitated, if a plurality of terminals 50*a*, 50*b* and 50*c* for attaching the lead wire are integrally formed at the time of molding at substantially equal space intervals around the outer peripheral edge of the electrically conductive cylindrical body 40 in numbers same as that of the commutator segments as shown in FIGS. 17 and 18. In this case, if the terminals 50*a*, 50*b* and 50*c* are shaped in the same length as that of the electrically conductive cylindrical body 40, as shown with double-dot-and-dash lines in FIG. 17, after which the double-dot-and-dash line portion is removed by cutting, leaving only the solid line portion, manufacture of the shaping mold is facilitated.

Further, as shown in FIG. 18, when a plurality of radial slits 44*a*, 44*b* and 44*c* are formed at substantially equal space intervals from the inner surface of the electrically conductive cylindrical body 40, the electrically insulative synthetic resin 44 can also be filled in these slits and solidified therein, so that integration between the commutator segments 40*a*, 40*b* and 40*c* and the synthetic resin bearing member 44, after division of the electrically conductive cylinder body 40, can be reinforced on comparison with the embodiment as illustrated in FIGS. 14A to 16B. In this case, the slits 46*a*, 46*b* and 46*c* which divide the electrically conductive cylinder member 40 can be formed from the outer surface of the cylinderical body toward the abovementioned slits 44*a*, 44*b* and 44*c*.

For shaping the thick wall portions at both ends of the electrically conductive cylinder body 40 to assume a tapered inclined surface, the outer periphery of the cylinder body is scraped by a cutting blade as mentioned in the above embodiment in FIG. 14A. Besides this, as shown in FIG. 19, a part of the thick wall portion at both ends of the cylindrical body 40 is notched from its inner periphery to form cuts 50, 50 to have the tapered inclined surface 42*a*.

Figure 19:
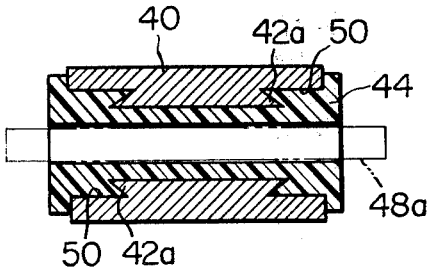
FIGS. 19 and 20 are respectively side elevational views in longitudinal cross section showing modified embodiments of the electrically conductive cylindrical body shown in FIG. 15B.
Figure 20:
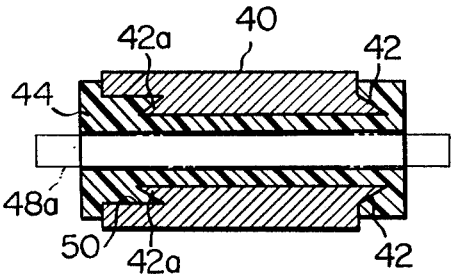

Moreover, the electrically conductive cylindrical body 40 may be formed at its one end as shown in FIG. 14B, and at the other end as shown in FIG. 19, as illustrated in FIG. 20.

Incidentally, the shaft 48*a* may be fitted in the cylindrical body 40 by either passing the same through the cylindrical body in advance and then fixing together by filling and solidification of the electrically insulative synthetic resin, or perforating a center hole through the cylindrical body, after formation of the commutator, through which the shaft 48*a* is passed and fixed with an adhesive.

Since the commutator according to the present invention is manufactured as such, it is possible to obtain readily and simply the commutator having uniform dimension in an industrial mass-production scale. Further, the thick wall portion at both ends of the commutator segments are sufficiently covered with the electrically insulative synthetic resin bearing member 44, the coupling between them is tight. Accordingly, even when the centrifugal force is acted on it, when it is used as the commutator, the commutator segments 40*a*, 40*b* and 40*c* are not separated from the bearing member 40, and the same can be used stably over a long period of time.

What is claimed is:

1. In a method for manufacturing a commutator, wherein a shaping material comprising an electrically conductive metal powder is placed in a shaping mold, compression-molded into an annular body, and sintered, re-compression being done on the sintered body, depending on necessity, to increase its mechanical strength and material hardness, the improvement comprising forming said annular body to have oppositely disposed spaced, generally radially extending, side surfaces with radially extending grooves in one of said side surfaces, and a peripheral surface; covering said grooved radial side, at least a portion of the peripheral surface and the center hollow portion and filling said grooves with an electrically insulative synthetic resin bearing material, the other side being exposed to a substantial degree; and cutting off the exposed surface side of said insulative material-coated annular body in parallel with the plane of said surface to a depth reaching said filled grooves in the opposite surface of said body thereby to define a plurality of commutator segments.

2. The method for manufacturing commutator as set forth in claim 1, in which said compression-molded electrically conductive annular body has an inclined outer peripheral surface toward one side surface where it is covered with said electrically insulative synthetic resin bearing material.

3. The method for manufacturing commutator as set forth in claim 1, in which said shaping material consists of from 85% to 95% of copper and 15% to 5% of carbon.

4. The method as set forth in claim 1, wherein said shaping material is a mixture of the electrically conductive metal powder and an additive material powder selected from the group consisting of carbon and molybdenum disulfide, which serve for enhancing electrical and mechanical characteristics of the commutator.

5. In a method for manufacturing commutator, wherein a shaping material comprising an electrically conductive metal powder is placed in a shaping mold, compression-molded into a hollow cylindrical body, and sintered, re-compression being done on the sintered body, depending on necessity, to increase its mechanical strength and material hardness, the improvement comprising introducing an electrically insulative synthetic resin material in the hollow cavity to integrally form a bearing member with said cylindrical body; and forming a plurality of grooves in said electrically conductive hollow cylindrical body from the outer peripheral surface thereof to a depth reaching said bearing material, and in parallel with the axial line, thereby defining a plurality of segments for the commutator.

6. The method for manufacturing commutator as set forth in claim 5, in which said electrically conductive hollow cylindrical body as molded has a plurality of radial slits extending from the inner surface up to a half way in said cylindrical body, and said electrically insulative synthetic resin material also fills in said radial slits to increase rigid combination with said cylindrical body.

7. In a method for manufacturing a commutator, wherein a shaping material comprising an electrically conductive metal powder is placed in a shaping mold, compression-molded into a hollow cylindrical body, and sintered, re-compression being done on the sintered body, depending on necessity, to increase its mechanical strength and material hardness, the improvement comprising forming a radially outwardly, axially inwardly convergent tapered annular keying surface adjacent the two ends of said cylindrical body, filling an electrically insulative synthetic resin material in the said hollow cylindrical body, covering said tapered annular surface at both ends of said cylindrical body integrally, to form a bearing member; and, thereafter, forming a plurality of radial grooves in said hollow cylindrical body to a depth reaching said electrically insulative synthetic resin bearing material at substantially equal space intervals from the outer peripheral surface thereof, thereby dividing said cylindrical body into a plurality of segments for the commutator.

8. The method for manufacturing commutator as set forth in claim 7, in which said shaping material consists of from 85% to 95% of copper and 15% to 5% of carbon.

* * * * *